US010924839B2

(12) United States Patent
Jou et al.

(10) Patent No.: US 10,924,839 B2
(45) Date of Patent: Feb. 16, 2021

(54) IN-EAR HEADPHONE

(71) Applicant: Merry Electronics(Shenzhen) Co., Ltd., ShenZhen (CN)

(72) Inventors: Hung-Uei Jou, Taichung (TW); Chung-Yi Huang, Taichung (TW)

(73) Assignee: Merry Electronics(Shenzhen) Co., Ltd., ShenZhen (CN)

( * ) Notice: Subject to any disclaimer, the term of this patent is extended or adjusted under 35 U.S.C. 154(b) by 0 days.

(21) Appl. No.: 16/594,097

(22) Filed: Oct. 7, 2019

(65) Prior Publication Data

US 2021/0006884 A1 Jan. 7, 2021

(30) Foreign Application Priority Data

Jul. 1, 2019 (TW) ..... 108123039 A

(51) Int. Cl.
*H04R 1/10* (2006.01)
*H04R 1/04* (2006.01)

(52) U.S. Cl.
CPC ..... *H04R 1/1016* (2013.01); *H04R 1/04* (2013.01); *H04R 1/1066* (2013.01); *H04R 2201/10* (2013.01)

(58) Field of Classification Search
CPC ..... H04R 1/10; H04R 1/1016; H04R 1/1041
See application file for complete search history.

(56) References Cited

U.S. PATENT DOCUMENTS

| | | | | |
|---|---|---|---|---|
| 9,237,394 | B2 * | 1/2016 | Seo | H04R 1/1016 |
| 2011/0182457 | A1 * | 7/2011 | Tung | H04R 1/1041 381/380 |
| 2019/0075384 | A1 * | 3/2019 | Miwa | H04R 1/1075 |

* cited by examiner

*Primary Examiner* — Kile O Blair
(74) *Attorney, Agent, or Firm* — JCIPRNET

(57) ABSTRACT

An in-ear headphone includes a shell, a speaker, a circuit board, and a sensing structure. The shell has an accommodating space. The speaker is disposed in the accommodating space. The circuit board is disposed in the accommodating space, and the circuit board is electrically connected to the speaker. A sensing chip is disposed on the circuit board. The sensing structure includes a sensing sound tube and a transmission member. The sensing sound tube protrudes from a front end of the shell and has a conductor. The sensing sound tube is electrically connected to the sensing chip by the transmission member. A material of the sensing sound tube is different from a material of the shell.

10 Claims, 7 Drawing Sheets

IN-EAR HEADPHONE

CROSS-REFERENCE TO RELATED APPLICATION

This application claims the priority benefit of Taiwan application serial no. 108123039, filed on Jul. 1, 2019. The entirety of the above-mentioned patent application is hereby incorporated by reference herein and made a part of this specification.

BACKGROUND OF THE INVENTION

1. Field of the Invention

The present invention relates to a headphone, in particular to an in-ear headphone.

2. Description of Related Art

With the evolution of the times, a smart phone with a headphone can be used as a portable music player. Moreover, at present, many business persons, commuters and students often use Walkman or mobile phones to listen to music or radio when walking, bicycling or taking public vehicles.

With the development of science and technology, many manufacturers have equipped the headphones with sensing structures to detect whether users have worn headphones in their ears. Therefore, how to make the sensing structure in the headphone integrate the wearing comfort of the user and sensing sensitivity is a very important task.

SUMMARY OF THE INVENTION

The present invention provides an in-ear headphone which is provided with a sensing sound tube with larger sensing area, thereby having better sensing effect.

The in-ear headphone of the present invention includes a shell, a speaker, a circuit board and a sensing structure. The shell internally includes an accommodating space. The speaker is disposed in the accommodating space. The circuit board is disposed in the accommodating space, and the circuit board is electrically connected to the speaker. A sensing chip is disposed on the circuit board. The sensing structure includes a sensing sound tube and a transmission member. The sensing sound tube protrudes from a front end of the shell and has a conductor. The sensing sound tube is electrically connected to the sensing chip by the transmission member. A material of the sensing sound tube is different from a material of the shell.

In one embodiment of the present invention, the accommodating space is defined with a front cavity and a rear cavity by the arrangement of the accommodating space. The circuit board is located in the rear cavity. The sensing sound tube is partially located in the front cavity and communicated with the front cavity.

In one embodiment of the present invention, the front cavity is communicated with the rear cavity through a guide channel. The pressure of the front cavity is guided to the rear cavity by the guide channel.

In one embodiment of the present invention, the in-ear headphone further includes an inner support disposed in the accommodating space. The speaker is located inside the inner support. The guide channel is formed in at least one of the inner support and the shell.

In one embodiment of the present invention, the rear cavity is provided with a pressure relief hole. The pressure of the front cavity is released from the pressure relief hole successively through the guide channel and the rear cavity.

In one embodiment of the present invention, the shell includes a front cover and a rear cover assembled to the front cover. The sensing sound tube protrudes from the front end of the front cover. The rear end of the front cover and the rear cover jointly form the rear cavity. The pressure relief hole is formed in the rear cover.

In one embodiment of the present invention, the in-ear headphone further includes an inner support disposed in the accommodating space. The speaker is located inside the inner support. A groove is formed between the inner support and the shell. The transmission member is located in the groove.

In one embodiment of the present invention, the shell includes a front cover. The front cover is provided with an opening and includes a concave platform encircling the opening. The sensing sound tube includes a flange protruding from an outer wall. The flange of the sensing sound tube is fixed on the concave platform of the front cover.

In one embodiment of the present invention, the whole sensing sound tube is a conductor, and the whole shell is a non-conductor.

In one embodiment of the present invention, the speaker is provided with a sound outlet surface, and the sound outlet surface faces a sound outlet of the sensing sound tube.

In one embodiment of the present invention, an outer diameter of the sensing sound tube is between 4 mm and 5 mm.

In one embodiment of the present invention, the shell includes a front cover and a rear cover assembled to the front cover. The sensing sound tube protrudes from the front end of the front cover. The front cover does not have the pressure relief hole.

Based on the above, in the in-ear headphone provided by the present invention, the front end of the sensing sound tube protrudes from the shell, and the sensing sound tube is electrically connected to the sensing chip through the transmission member. Since the sensing sound tube is the conductor, and the protruding sensing sound tube has larger overall sensing area, the sensing effect is better, whether a user wears the headphone can be more sensitively sensed, the sensing sensitivity of the sensing sound tube can also be preset as a relatively small value, thereby achieving a power saving effect. In other words, the design that the sensing sound tube of the in-ear headphone protrudes from the shell enables the in-ear headphone to integrate good sensing effect, power conservation and sufficient sensing sensitivity. In addition, since the material of the sensing sound tube is different from the material of the shell, the sensing chip can be effectively prevented from recognizing the information that a user contacts or approaches the shell as the condition that the user contacts or approaches the sensing sound tube, therefore, the in-ear headphone can have good sensitivity.

In order to make the aforementioned features and advantages of the present invention more comprehensible, embodiments accompanied with accompanying drawings are described in detail below.

DESCRIPTION OF THE EMBODIMENTS

Generally speaking, a majority of conventional automatic detection headphones adopt the capacitive detection technology. Specifically, when a sensing structure is disposed in a headphone, whether a user plugs the headphone into ear canals can be sensed. In this case, an outer diameter of the sensing structure influences an outer diameter of a shell of the headphone which is plugged into the ear canal, which may influence the comfort of the user when wearing the headphone. Moreover, if the sensitivity of the sensing structure is to be enhanced without increasing the outer diameter of the sensing structure, the electric quantity supplied to the sensing structure must be increased. The electric quantity stored by the headphone is already very limited, and the use of the above method influences the charge capacity of the headphone to certain extent. Therefore, how to match the sensing structure with the shell structure of the headphone to achieve better sensitivity, power-saving effect and wearing comfort of the sensing structure is an important issue. The present invention provides an in-ear headphone to solve the foregoing problems.

Figure 1:
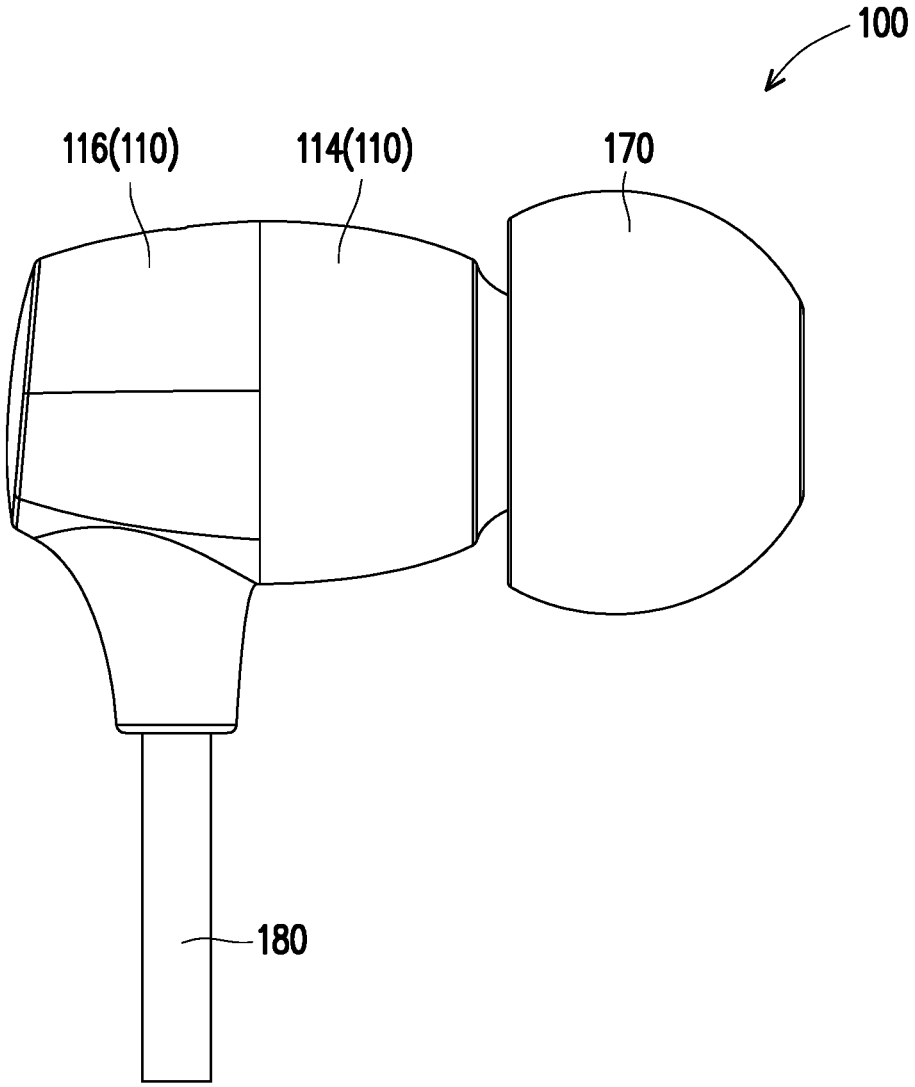
FIG. 1 is a side schematic view of an in-ear headphone according to an embodiment of the present invention.
Figure 2:
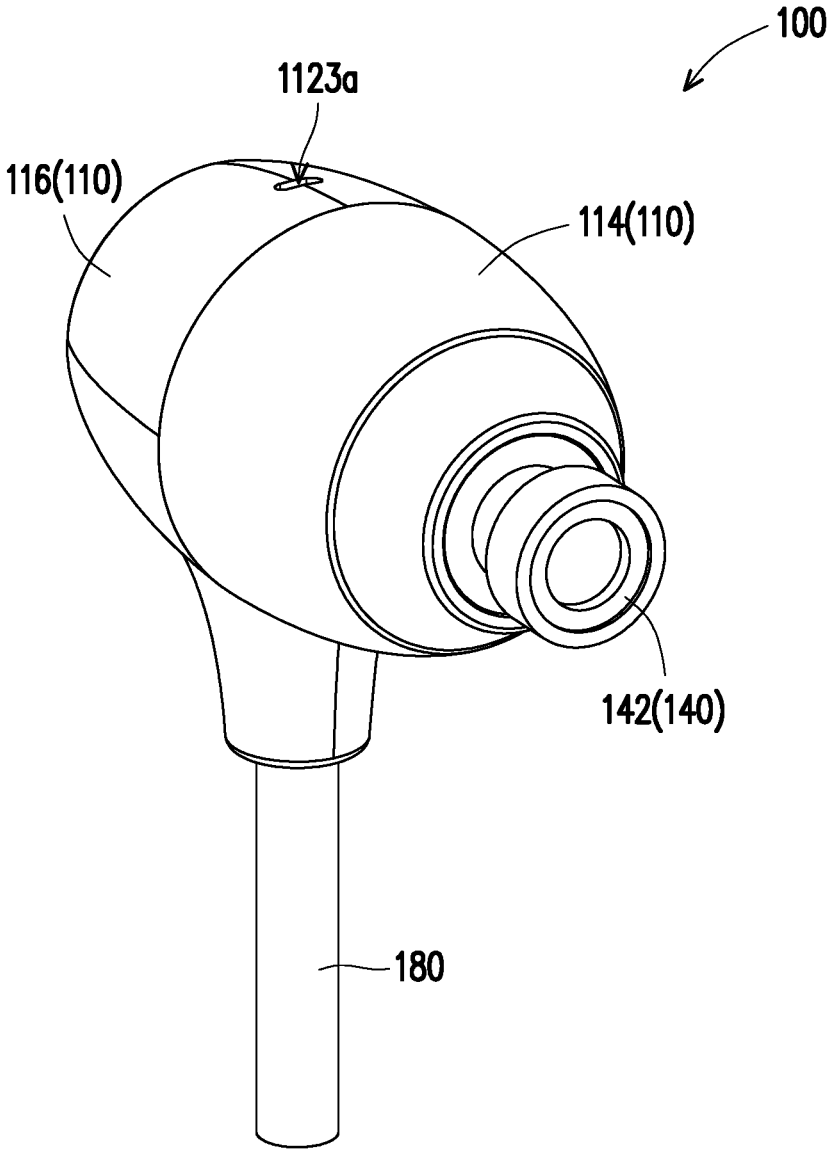
FIG. 2 is a three-dimensional schematic diagram of the in-ear headphone of FIG. 1.
Figure 3:
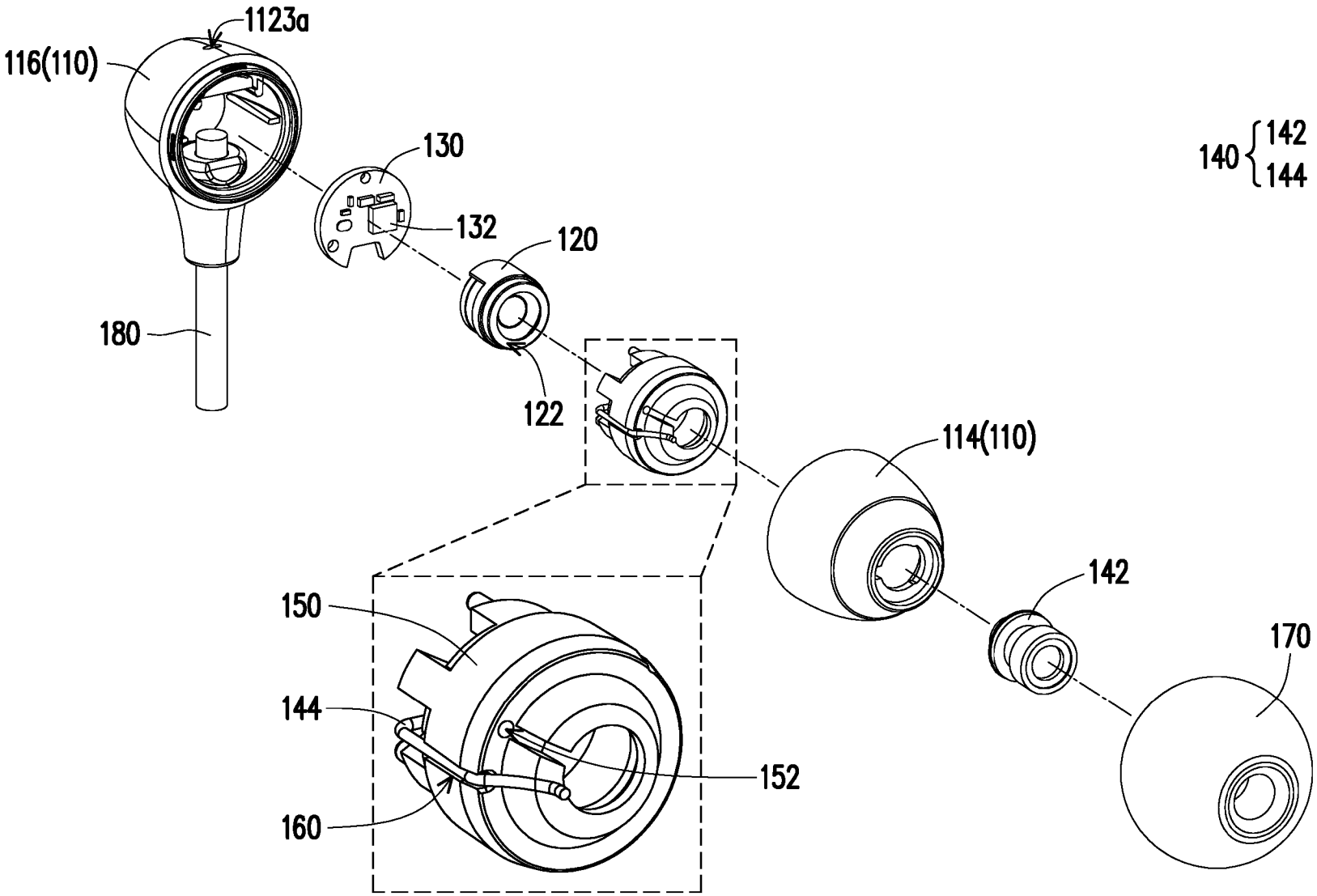
FIG. 3 is an exploded schematic diagram of the in-ear headphone of FIG. 1.

FIG. 1 is a side schematic view of an in-ear headphone according to an embodiment of the present invention. FIG. 2 is a three-dimensional schematic diagram of the in-ear headphone of FIG. 1. FIG. 3 is an exploded schematic diagram of the in-ear headphone of FIG. 1. Referring to FIG. 1 to FIG. 3, in the present embodiment, the in-ear headphone 100 includes a shell 110, a speaker 120 (FIG. 3), a circuit board 130 (FIG. 3) and a sensing structure 140 (FIG. 2). Furthermore, as shown in FIG. 2 and FIG. 3, the in-ear headphone 100 of the present embodiment further includes an earplug sleeve 170 disposed on the sensing structure 140 in a replaceable manner.

It should be noted that in the present embodiment, in order to clearly describe the appearance of the sensing structure 140, the structure of the earplug sleeve 170 is omitted in FIG. 2. Moreover, the earplug sleeve with an appropriate size or shape can be replaced by the user according to the actual requirements, and the shape and size of the earplug sleeve are not limited herein. On the other hand, the in-ear headphone 100 of the present embodiment is provided with a headphone cable 180. However, in other embodiments not shown, the in-ear headphone 100 is not necessarily to be the cabled headphone but may be a wireless headphone, a Bluetooth headphone, a hand-free telephone receiver and other devices, and the present invention is not limited thereto.

Figure 4:
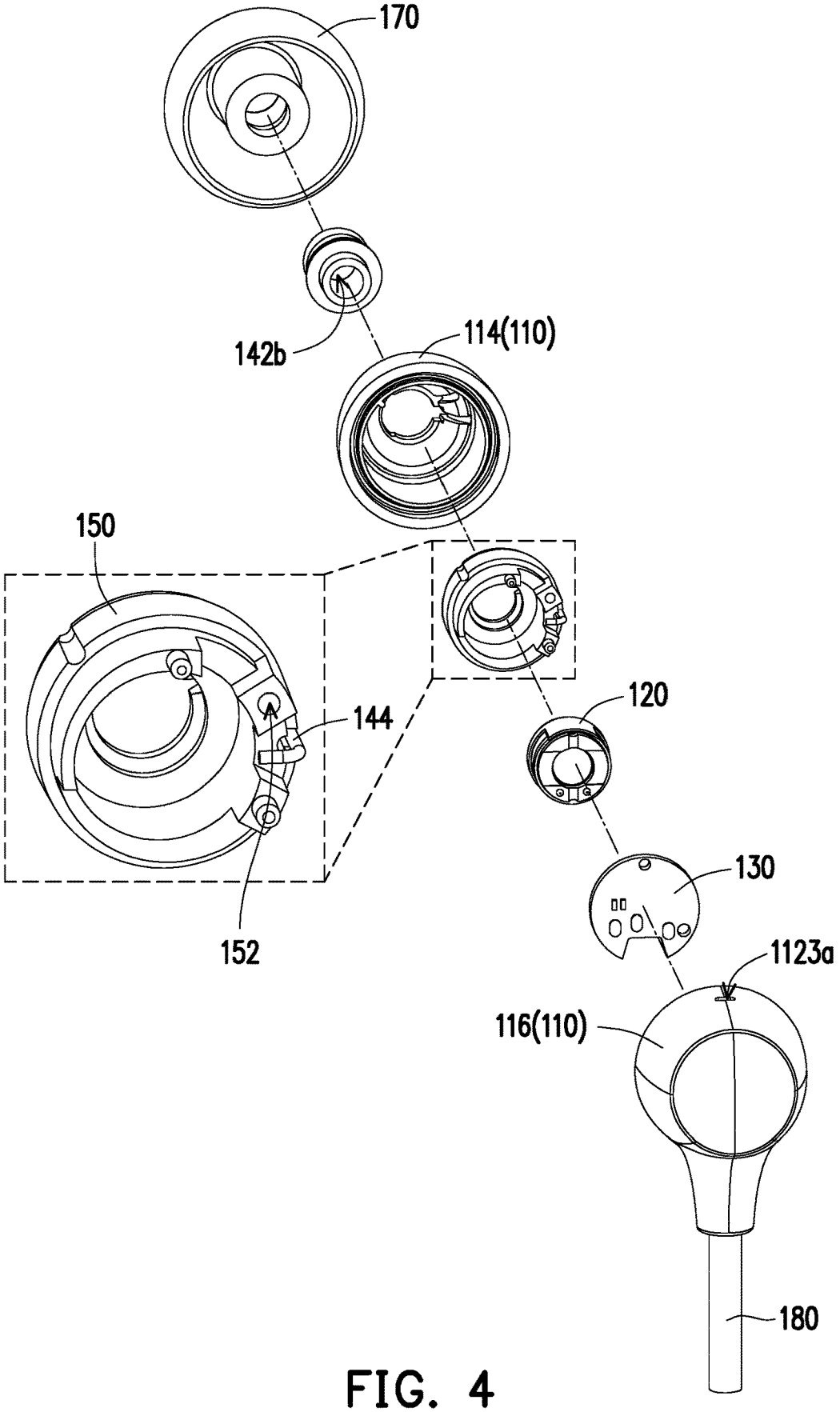
FIG. 4 is an exploded schematic diagram of the in-ear headphone of FIG. 1 from another view.
Figure 5:
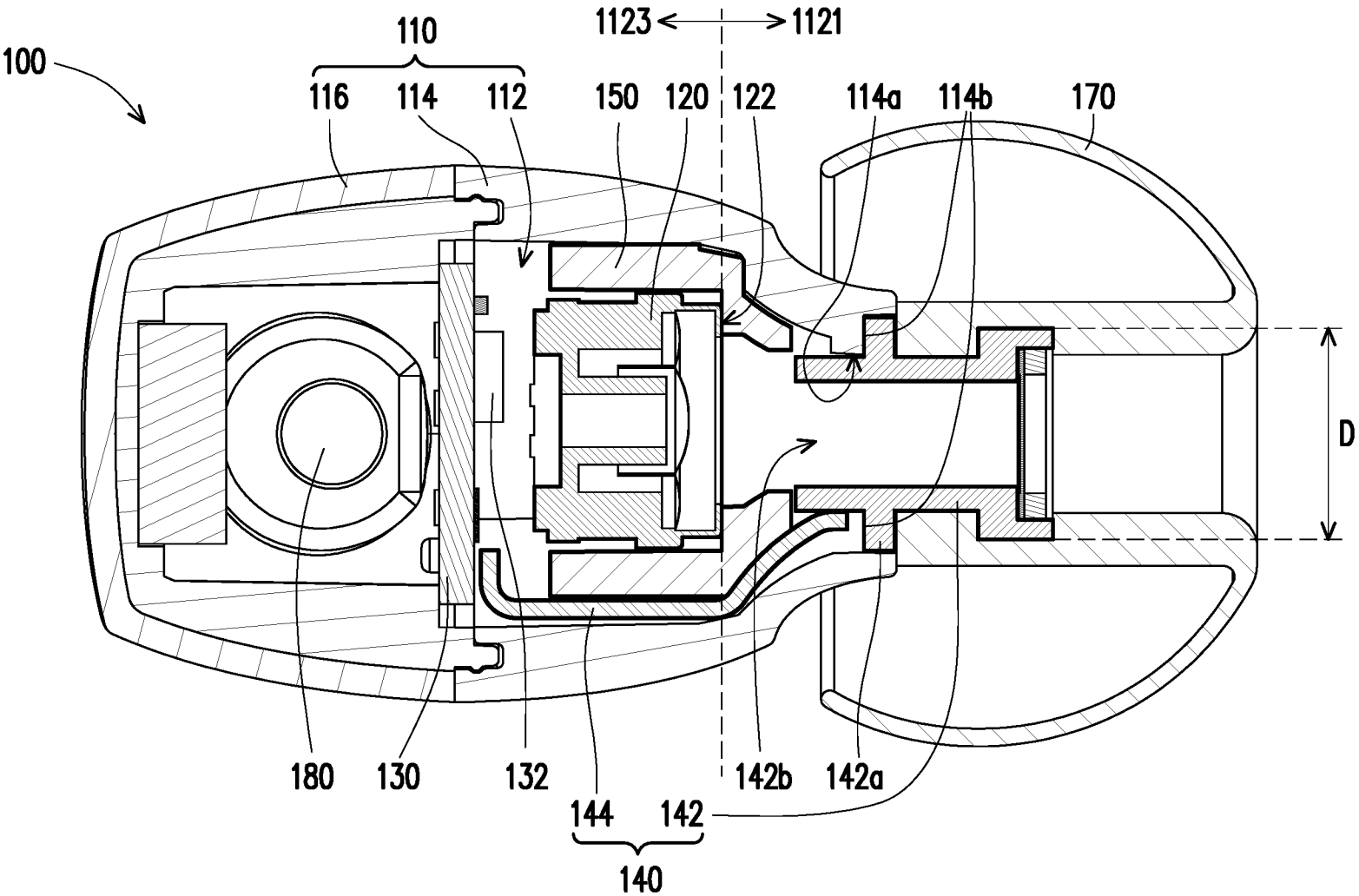
FIG. 5 is a cross-sectional schematic diagram of the in-ear headphone of FIG. 1.

FIG. 4 is a cross-sectional schematic diagram of the in-ear headphone of FIG. 1. FIG. 5 is a cross-sectional schematic diagram of the in-ear headphone of FIG. 1. Referring to FIG. 2 to FIG. 5, in the present embodiment, the shell 110 is internally provided with an accommodating space 112 (FIG. 5). The speaker 120 and the circuit board 130 are disposed in the accommodating space 112. The sensing structure 140 includes a sensing sound tube 142 and a transmission member 144. A sensing chip 132 is disposed on the circuit board 130. The sensing sound tube 142 is a conductor and is electrically connected to the sensing chip 132 of the circuit board 130 by the transmission member 144.

Referring to FIG. 5, in the present embodiment, the accommodating space 112 is defined with a front cavity 1121 and a rear cavity 1123 by the arrangement of the speaker 120. The shell 110 includes a front cover 114 and a rear cover 116 assembled to the front cover 114. Moreover, the rear end of the front cover 114 and the rear cover 116 jointly form the rear cavity 1123. Specifically, the speaker 120 is provided with a sound outlet surface 122, and the sound outlet surface 122 faces a sound outlet **142*b* of the sensing sound tube 142. In other words, the speaker 120 of the in-ear headphone 100 of the present embodiment adopts a front sound outlet manner. Of course, the sound outlet manner of the in-ear headphone 100** is not limited thereto.

Specifically, taking the direction of FIG. 5 as an example, in the present embodiment, the part of the accommodating space 112 located on the right side of the sound outlet surface 122 is defined as the front cavity 1121, and the part located on the left side of the sound outlet surface is defined as the rear cavity 1123. Of course, in other embodiments not shown, the sound outlet surface 122 of the speaker 120 is unnecessary in a form as in FIG. 5. The accommodating space 112 may be divided into the front cavity 1121 and the rear cavity 1123 by directly referring to the speaker 120 rather than the sound outlet surface 122, and the present invention is not limited thereto.

Further, referring to FIG. 5, in the present embodiment, the circuit board 130 is disposed in the rear cavity 1123. The sensing sound tube 142 protrudes from the shell 110. In detail, the front cover 114 of the present embodiment is provided with an opening **114*a*. Moreover, the sensing sound tube 142 is partially located in the front cavity 1121, and the sensing sound tube 142 protrudes from the front end of the front cover 114 via the opening 114*a* and is communicated with the front cavity 1121. Thus, the front end of the sensing sound tube 142 of the present embodiment partially extends out of the shell 110** and is closer to the ear canal of the user.

It should be noted that when the in-ear headphone 100 of the present embodiment is in operation, the circuit board 130 may continuously supply power to the sensing sound tube 142, and electrons or charges may be distributed on the sensing sound tube 142. As the human body approaches or contacts the sensing sound tube 142 (for example, the sensing sound tube 142 is disposed in the ear canal or approaches the ear canal), the number or/and distribution of electrons or charges on the sensing sound tube 142 may be changed, and the sensing chip 132 is suitable for sensing a received signal value and comparing whether the signal value is changed. Or, the sensing chip 132 may be stored with a preset value and is suitable for comparing whether a difference between the received signal value and the pre-set value is greater than a specific range. If yes, indicating that the in-ear headphone 100 is disposed in the ear canal or taken out of the ear canal, and the circuit board 130 can be correspondingly operated to play music or stop playing music.

Therefore, based on the design of the present embodiment, by increasing a length of the sensing sound tube 142, the sensing sound tube 142 can be closer to the ear canal of the user, thereby more sensitively sensing whether the user plugs the headphone into the ear canal or not. Furthermore, the overall mass of the sensing sound tube 142 increases, and the sensing range can be enlarged, thereby having good sensitivity. Therefore, it is unnecessary to increase the outer diameter D of the sensing sound tube 142 to increase the sensing area. Consequently, the outer diameter D of the sensing sound tube 142 of the present embodiment is only between 4 mm and 5 mm, which falls in a size range that is comfortable for the ear canal of the human body, thereby providing better user experience. On the other hand, with the above arrangement, the sensing sensitivity of the sensing sound tube 142 of the present embodiment may also be preset as a small value to achieve a power-saving effect.

Moreover, in the present embodiment, the front cover 114 further includes a concave platform 114*b* encircling the opening 114*a*. As shown in FIG. 4, the sensing sound tube 142 of the present embodiment includes a flange 142*a* protruding from the outer wall, and the flange 142*a* of the sensing sound tube 142 is fixed on the concave platform 114*b* of the front cover 114. It should be noted that in the present embodiment, the flange 142*a* of the sensing sound tube 142, for example, is adhered to the concave platform 114*b* of the front cover 114. Of course, in other embodiments, the flange 142*a* of the sensing sound tube 142 and the concave platform 114*b* of the front cover 114 can be fixed in other non-adhesion manners and the present invention is not limited thereto. The matching of the concave platform 114*b* of the front cover 114 and the flange 142*a* of the sensing sound tube 142 can increase a contact area therebetween, so that the sensing sound tube 142 can be firmly fixed on the front cover 114.

It should be noted that in the present embodiment, the material of the sensing sound tube 142 is different from the material of the shell 110. In detail, the sensing sound tube 142 of the present embodiment is made of a conductive material, for example, the sensing sound tube 142 is a metal sensing sound tube 142, but is not limited thereto. The entire shell 110 of the in-ear headphone 100 of the present embodiment is made of a non-conductive material, for example, plastics, but is not limited thereto. Based on the design, the recognition error made by the sensing chip 132 when the user contacts the shell 110 can be prevented. For example, in the present embodiment, the sensing sound tube 142 adopts a capacitive detection way, and the ear canal and fingers of the user are skin. If the shell 110 is a conductor, when the user holds the headphone, the recognition error may be possibly made by the sensing chip 132. Therefore, in the present embodiment, the material of the sensing sound tube 142 is different from the material of the shell 110, so that the above condition can be avoided.

Please continue to refer to FIG. 3 and FIG. 5. In the present embodiment, the in-ear headphone 100 selectively further includes an inner support 150 disposed in the accommodating space 112. The speaker 120 is disposed inside the inner support 150. A groove 160 is formed between the inner support 150 and the shell 110, and the transmission member 144 is arranged in the groove 160. Specifically, in the present embodiment, the groove 160 is formed in the inner support 150 and the shell 110. A contour of the groove 160 located in the inner support 150 and a contour of the groove 160 located in the shell 110 may correspond to an outer contour of the transmission member 144. More specifically, in the present embodiment, a space is formed between the groove 160 and a housing (shell 110), and the transmission member 144 is disposed in the space. Of course, in other embodiments not shown, the groove 160 may not be formed in the inner support 150 or the shell 110, as long as a space is provided between the inner support 150 and the housing (shell 110), so that the transmission member 144 can be communicated with the front cavity 1121 and the rear cavity 1123 and connected with the circuit board 130 and the sensing sound tube 142, and the circuit board 130 of the present embodiment can be electrically connected with the sensing sound tube 142.

Figure 6:
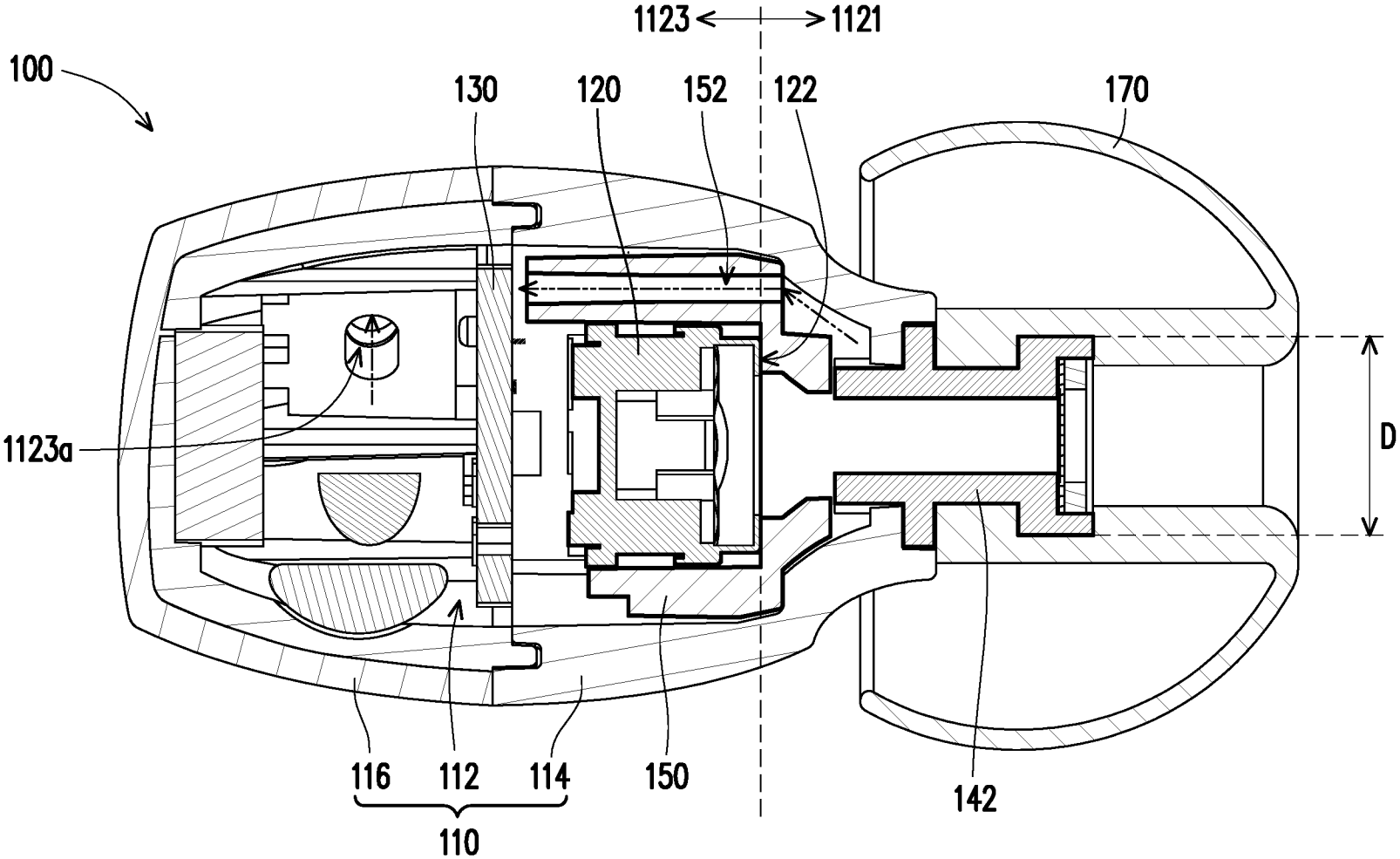
FIG. 6 is another cross-sectional schematic diagram of the in-ear headphone of FIG. 1.

FIG. 6 is another cross-sectional schematic diagram of the in-ear headphone of FIG. 1. Referring to FIG. 4 and FIG. 6, in the present embodiment, the front cavity 1121 is communicated with the rear cavity 1123 through a guide channel 152, and the guide channel 152 is formed in the inner support 150, so that the pressure of the front cavity 1121 can be led to the rear cavity 1123 by the guide channel 152. It should be noted that in other embodiments not shown, the guide channel 152 may also be formed in the shell 110 or formed between the inner support 150 and the shell 110. In other words, as long as the guide channel 152 can communicate the front cavity 1121 and the rear cavity 1123 to enable the pressure of the front cavity 1121 to be led to the rear cavity 1123 by the guide channel 152. The position and form of the guide channel 152 are not limited herein.

Figure 7:
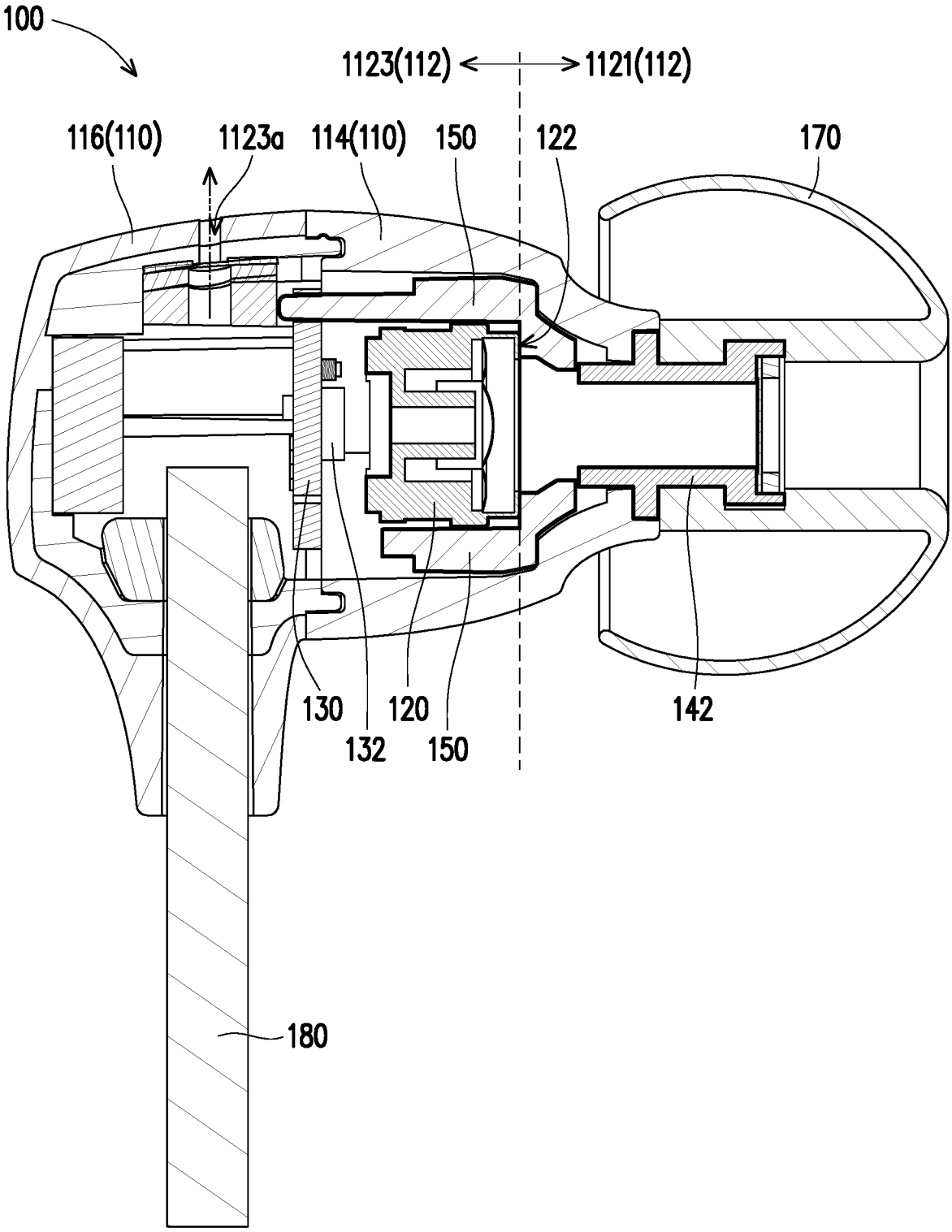
FIG. 7 is still another cross-sectional schematic diagram of the in-ear headphone of FIG. 1.

FIG. 7 is still another cross-sectional schematic diagram of the in-ear headphone of FIG. 1. Please referring to FIG. 2, FIG. 6 and FIG. 7, the rear cavity 1123 of the present embodiment is provided with a pressure relief hole 1123*a*, and the pressure relief hole 1123*a* is formed in the rear cover 116. Based on the above structure, as shown in FIG. 6, the pressure of the front cavity 1121 can be released from the pressure relief hole 1123*a* successively through the guide channel 152 and the rear cavity 1123.

It is worth mentioning that, based on the above design, in the present embodiment, the front cavity 1121 is not provided with the pressure relief hole, in other words, the front cover 114 of the present embodiment does not need an additional hole (pressure relief hole). In this way, compared with the conventional headphone structure which the front cavity and the rear cavity must be respectively provided with the pressure relief hole for releasing the pressure in the front cavity and the rear cavity, the front cover 114 of the present embodiment does not need the pressure relief hole, so that the structure of the front cover 114 may not be limited by the pressure relief hole, and the space inside the front cover 114 can be more flexibly arranged. The front cover 114 can also have high structural strength, so that the problem that tuning paper is difficult to dispose can be better solved.

Based on the above, in the in-ear headphone, the front end of the sensing sound tube protrudes from the shell, and the sensing sound tube is electrically connected to the sensing chip through the transmission member. In this way, the protruding sensing sound tube can more sensitively sense whether the user wears the headphone, without the need of increasing the sensing area by increasing the outer diameter of the sensing sound tube. Moreover, the set value of the sensing sensitivity may also be relatively low, thereby saving the power. In other words, the design that the sensing sound tube of the in-ear headphone protrudes from the shell enables the in-ear headphone to integrate the wearing comfort of the user and sufficient sensitivity. In addition, since the material of the sensing sound tube is different from the material of the shell, the sensing chip can be effectively prevented from recognizing the information that the user contacts or approaches the shell as the condition that the user contacts or approaches the sensing sound tube, therefore, the in-ear headphone can have good sensitivity. On the other hand, the front cavity and the rear cavity of the in-ear headphone are mutually communicated. Therefore, the pressure in the accommodating space can be released only by arranging the pressure relief hole in the rear cavity. The structure of the front cover can be simpler. Other elements disposed in the front cover may be more flexible in space arrangement.

Although the present invention has been disclosed by the above embodiments, the embodiments are not intended to limit the present invention. It will be apparent to those skilled in the art that various modifications and variations can be made to the present invention without departing from the spirit and scope of the present invention. Accordingly, the protection scope of the present invention is defined by the scope of the appended claims.

What is claimed is:

1. An in-ear headphone, comprising:

a shell, internally comprising an accommodating space;

a speaker, disposed in the accommodating space;

a circuit board, disposed in the accommodating space, electrically connected to the speaker, and provided with a sensing chip;

a sensing structure, comprising a sensing sound tube and a transmission member, wherein the sensing sound tube protrudes from a front end of the shell and the whole sensing sound tube is a conductor, the sensing sound tube is electrically connected to the sensing chip by the transmission member, and a material of the sensing sound tube is different from a material of the shell, wherein the accommodating space is defined with a front cavity and a rear cavity by location of the speaker, the front cavity is communicated with the rear cavity through a guide channel, and pressure of the front cavity is guided to the rear cavity by the guide channel; and an inner support, disposed in the accommodating space, the speaker is located inside the inner support, and the guide channel is formed in at least one of the inner support and the shell.

2. The in-ear headphone according to claim 1, wherein the circuit board is located in the rear cavity, and the sensing sound tube is partially located in the front cavity and is communicated with the front cavity.

3. The in-ear headphone according to claim 1, wherein the rear cavity is provided with a pressure relief hole, and the pressure of the front cavity is released from the pressure relief hole successively through the guide channel and the rear cavity.

4. The in-ear headphone according to claim 3, wherein the shell comprises a front cover and a rear cover assembled to the front cover, the sensing sound tube protrudes from a front end of the front cover, a rear end of the front cover and the rear cover jointly form the rear cavity, and the pressure relief hole is formed in the rear cover.

5. The in-ear headphone according to claim 1, wherein a groove is formed between the inner support and the shell, and the transmission member is located in the groove.

6. The in-ear headphone according to claim 1, wherein the shell comprises a front cover, the front cover is provided with an opening and comprises a concave platform encircling the opening, the sensing sound tube comprises a flange protruding from an outer wall, and the flange of the sensing sound tube is fixed on the concave platform of the front cover.

7. The in-ear headphone according to claim 1, wherein the whole shell is a non-conductor.

8. The in-ear headphone according to claim 1, wherein the speaker is provided with a sound outlet surface, and the sound outlet surface faces a sound outlet of the sensing sound tube.

9. The in-ear headphone according to claim 1, wherein an outer diameter of the sensing sound tube is between 4 mm and 5 mm.

10. The in-ear headphone according to claim 1, wherein the shell comprises a front cover and a rear cover assembled to the front cover, the sensing sound tube protrudes from a front end of the front cover, and the front cover is not provided with a pressure relief hole.

* * * * *